US010184278B2

(12) United States Patent
Lowe

(10) Patent No.: US 10,184,278 B2
(45) Date of Patent: Jan. 22, 2019

(54) SECURITY DEVICES FOR DOORS

(71) Applicant: Silverback Safety & Training Solutions, Inc., Nashport, OH (US)

(72) Inventor: Troy Bryan Lowe, Nashport, OH (US)

(73) Assignee: Silverback Safety & Training Solutions, Inc., Nashport, OH (US)

( * ) Notice: Subject to any disclaimer, the term of this patent is extended or adjusted under 35 U.S.C. 154(b) by 813 days.

(21) Appl. No.: 14/250,680

(22) Filed: Apr. 11, 2014

(65) Prior Publication Data

US 2014/0306464 A1 Oct. 16, 2014

Related U.S. Application Data

(60) Provisional application No. 61/858,709, filed on Jul. 26, 2013, provisional application No. 61/825,576, filed on May 21, 2013, provisional application No. 61/811,201, filed on Apr. 12, 2013.

(51) Int. Cl.

| | |
|---|---|
| ***E05C 19/00*** | (2006.01) |
| ***E05C 19/18*** | (2006.01) |
| *E05F 3/00* | (2006.01) |
| *E05F 3/22* | (2006.01) |

(52) U.S. Cl.

CPC ..... *E05C 19/003* (2013.01); *E05C 19/184* (2013.01); *E05F 3/00* (2013.01); *E05F 3/22* (2013.01); *E05Y 2201/22* (2013.01); *E05Y 2201/244* (2013.01); *E05Y 2800/426* (2013.01); *E05Y 2800/70* (2013.01); *Y10T 292/23* (2015.04); *Y10T 292/237* (2015.04)

(58) Field of Classification Search

CPC ..... E05C 19/003; E05C 19/184; E05F 3/00; E05F 3/22; E05Y 2201/22; E05Y 2201/244; E05Y 2800/426; E05Y 2800/70; Y10T 292/237; Y10T 292/23

USPC ..... 70/14, 416, 232, 18, 212, 16

See application file for complete search history.

(56) References Cited

U.S. PATENT DOCUMENTS

| | | | | |
|---|---|---|---|---|
| 3,819,216 | A | 6/1974 | Richardson | |
| 3,980,328 | A * | 9/1976 | Pearson | E05C 19/003 220/315 |
| 4,529,235 | A | 7/1985 | Florentine, Sr. | |

(Continued)

FOREIGN PATENT DOCUMENTS

| | | |
|---|---|---|
| JP | 20050009128 | 3/2005 |

*Primary Examiner* — Kristina R Fulton
*Assistant Examiner* — Thomas L Neubauer
(74) *Attorney, Agent, or Firm* — Jason H. Foster; Kremblas & Foster

(57) ABSTRACT

A door security device for preventing opening of a door. A first device includes a bar that seats against a doorframe on opposite sides of the door and a clamp that clasps a door latch and applies a force to draw the bar against the doorframe while pulling the door latch toward the bar. The door cannot be opened away from the bar. A second device has a bar that seats against a doorframe at the floor with a two plates that extend beneath the door and around to opposite sides of the doorframe. Removable pins or other locks obstruct the plates from sliding along the bar. The bar is tall enough that the door cannot pass over the bar, thus obstructing the door from opening inwardly. A closer cover slides over a mechanical door closing mechanism to be used alone or with the other devices.

5 Claims, 9 Drawing Sheets

(56) References Cited

U.S. PATENT DOCUMENTS

| | | | | |
|---|---|---|---|---|
| 4,852,921 | A * | 8/1989 | Gilbert | E05C 19/003 292/259 R |
| 4,955,648 | A | 9/1990 | Miller | |
| 5,340,172 | A | 8/1994 | Sweet | |
| 5,605,364 | A * | 2/1997 | Shelledy | E05C 19/003 292/259 R |
| 5,826,923 | A | 10/1998 | Bethurem | |
| 6,394,510 | B1 * | 5/2002 | Stewart, III | E05B 65/0888 292/264 |
| 6,560,925 | B1 | 5/2003 | Rice | |
| 7,637,130 | B2 | 12/2009 | Carr | |
| 2002/0088255 | A1 | 7/2002 | Moores | |

* cited by examiner

SECURITY DEVICES FOR DOORS

CROSS-REFERENCES TO RELATED APPLICATIONS

This application claims the benefit of U.S. Provisional Application No. 61/811,201 filed Apr. 12, 2013. This application claims the benefit of U.S. Provisional Application No. 61/825,576 filed May 21, 2013. This application claims the benefit of U.S. Provisional Application No. 61/858,709 filed Jul. 26, 2013. All of these prior applications are hereby incorporated by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

The invention relates generally to security devices, and more particularly to a security device engaged on one side of a door for preventing the opening of the door from the opposite side.

Many interior doors of residential and institutional facilities have minimal security features, such as a simple latch or locking mechanism. This is sufficient in a home where the desire to prevent entry results from privacy concerns. Even when security is required, the interior doors of institutions, such as secondary schools and universities, have only been designed to prevent entry by a criminal or vandal who seeks a quick and anonymous entry and exit. Such people seek to, for example, steal electronics, access academic records or deface a facility. Petty criminals or vandals rarely take action that attracts attention, such as breaking down a door or smashing glass.

Furthermore, many institutions are subject to mandatory safety rules, such as fire codes, which may limit the measures that can be taken to secure the facility to any degree beyond the mischievous criminal or vandal. For example, secondary school doors may be required to be passable at all times to allow appropriate ingress and egress. Even doors with adequate locks for schools buildings provide little resistance to a criminal intruder who seeks to enter the facility with more in mind than vandalism or petty crimes.

The lack of adequate barriers to a facility presents a problem in circumstances where an intruder to a facility is what has become known as an "active shooter" and the facility is a school or university. Such a person enters an educational institution with a desire to harm people with firearms and explosives he or she brought to the facility. Such a person also exhibits little self-preservation other than for a short period to inflict the most harm to the highest number of innocent students and staff. Therefore, such persons do not observe historic limitations on the sound their actions create or the violence with which they attack a locked door or the occupants of the room behind the locked door.

In recent years, students and staff of such institutions have been trained to blockade doors with desks and any other objects to prevent or slow entry by the active shooter. This is because it has become clear that, in their effort to harm the most people in the least time, active shooters will not "waste" time at a door that provides substantial resistance. Active shooters know that authorities will come quickly to stop the violence, and therefore they do not spend the small amount of time they have with a door that provides substantial resistance.

In such a situation, if an intended target of such a shooter can secure a door rapidly, then the chances of survival for the intended target and all others under his or her care are greatly increased. It has been demonstrated that the longer it takes for an intruder to gain access to a room of intended victims, the fewer injuries he or she can cause before being apprehended or killed. Thus, the ability to rapidly secure a door, and keep it secured despite the door and lock being shot by the shooter, are essential elements for any device that is intended to prevent an atrocity by an active shooter.

The need exists for a means for preventing entry through a door by an active shooter, and the means should provide maximum resistance to entry, be rapidly deployable without substantial skill and have no permanent attachment prior to use in order to comply with safety regulations.

BRIEF SUMMARY OF THE INVENTION

A door barricade apparatus is described comprising two components that can be used together or separately. A security bar is used to block a door from being opened, and a cover is used to jamb a mechanical door closer to prevent opening of the door. The cover is placed over the door closer, and can be secured in place with frictional engagement with the sidewalls, and/or a pin that attaches to the cover via a lanyard, chain or magnet to prevent the pin from separating from the device during storage. The secured cover prevents the closer from expanding, which prevents the door from opening.

The security bar is used on the door, such as a conventional swinging door that is commonly found in an institutional building. Such a door pivotably mounts to a vertical doorframe on one side and has a door latching and/or locking apparatus on the opposite side. Preferably one or more hinges mount the door to the first doorframe, and an opposing doorframe includes a strike plate to receive the door latching apparatus, typically a bolt or other protruding structure. In use, the door pivots about the hinges between an opened position and a closed position, and the door latch secures the door in the closed position upon insertion of the bolt into the strike plate. It is well known that some doorframes are formed by wooden members, commonly referred to as "studs" to which wooden jambs are nailed or screwed. Other doorframes are formed by metal studs to which wooden jambs are fastened. Still further, other doorframes are formed by metal jambs that are fastened to wooden or metal studs that form the structural framework of a wall. In all cases, a door's doorframe, as that term is used herein, is the structural portion of the door's frame that provides sufficient strength to reinforce the door against opening by a human.

One security bar includes an attachment to secure around a door latch to prevent a person on the opposite side of the door from gaining entry by pulling the door. The bar and cover can be used separately or together to secure such a door in a closed position, which is useful to prevent unwanted access from an individual on the opposite side of a door once the present invention is engaged. No component of the bar is mounted to the door or any surrounding structure until the entire bar is attached to the door handle and frame. The entire apparatus can later be completely removed.

The security bar includes an elongated member that extends across the width of a door and preferably includes vertical footpads on the ends of the bar to abut a doorframe, doorframe trim or a wall. Extending horizontally from the bar is a door-opening latch grasping mechanism, which preferably includes a claw that slides over and around the opposing sides of a conventional door latch, such as a door knob or lever. The claw is designed to accommodate any door latch to suit user needs, including knobs, levers and "crash bar" and "panic bar" mechanisms, along with other types of door opening structures. The claw slides along the bar before being placed over the door latch to accommodate a latch on the right or left side of the door. After placing the claw over and around the latch, the device is tightened, preferably by rotating a rotatable handle in one direction, which is preferably marked clearly to reduce the probability of stress-induced error. When the device is tightened, it draws the bar against the doorframe or wall.

With the claw tightly attached to a door latch and the bar positioned with its ends along the doorframe or surrounding wall, the bar secures the door and prevents an intruder or individual on the outside of the door from being able to pull the door outward away from the bar. This is accomplished even though no structural features of the device are positioned on or around the door prior to attachment. This is advantageous because fire codes often prohibit any structure from being attached to a door or wall around a door.

Another apparatus prevents the opening of an inwardly swinging door by someone on the opposite side of the door. The apparatus includes an elongated bar with at least one plate, and preferably two plates, that are slidably mounted on the bar, such as by being welded to collars that are slidably mounted to the bar. The plates can be moved along the bar's length to one of many positions. Pins or other stopping means can be inserted into the bar to lock the plates to the bar or at least prevent the plates from moving toward one another along the bar past the pins.

The plates are sized to extend under the door from the inside of the room where the bar is positioned during installation. This prevents the user from having to exit the door to fasten the device in position, thereby placing the user at risk of being seen or injured by the intruder. After sliding the plates fully under the door until the bar rests against the inner surfaces of the vertical doorframes, the plates are slid outwardly away from one another on the bar to butt up against the doorframes and to extend legs of the plates to the opposite sides of the doorframes from the bar. The plates are then pinned to the bar, or at least prevented from moving inwardly, from inside the room. Pins prevent the intruder from kicking the plates out from the door jamb and thereby defeating the device. Because the bar and collars of the apparatus inside the door are taller than the gap under the door, the door cannot move past the bar. The apparatus thus attaches from the inside face of the doorframe to the outside face of the doorframe and presents an immovable obstacle to the door opening inwardly.

The bar devices described herein prevent a person on the outside of an inwardly or an outwardly swinging door from opening the door and gaining access to the occupants of the room. The closer cover can be deployed as a redundant device on the hydraulic closer mounted to the door if the door is so equipped. None of the devices described herein is permanently mounted to the door, doorframe or surrounding wall, but all are used as temporary barricades to keep intruders out.

The present invention provides an effective way for people to barricade themselves and others more safely inside a classroom, office or other room of a school, university, or any other building in the event of a mass shooting or other attack, or under any other circumstances. It will be apparent to the person of ordinary skill that the invention is able to be deployed rapidly without substantial likelihood of user error, even given highly stressful circumstances.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

Figure 1:
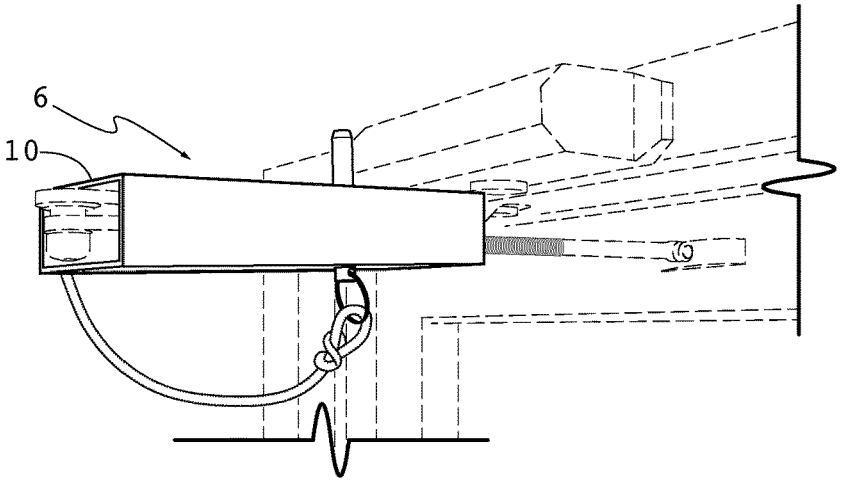
FIG. 1 is a view in perspective illustrating an embodiment of the invention that mounts to a conventional mechanical door closer.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional Application No. 61/811,201 filed Apr. 12, 2013; U.S. Provisional Application No. 61/825,576 filed May 21, 2013; and U.S. Provisional Application No. 61/858,709 filed Jul. 26, 2013 are hereby incorporated in this application by reference.

Multiple components are contemplated for use as security devices. A door closer cover portion 6 and a bar portion 20 can be use together or separately. The door closer cover portion 6 is described below in relation to FIGS. 1-3. The bar portion 20 is described below in relation to FIGS. 4-10, and another bar portion 118 is described in relation to FIGS. 11-19. The components of the bar portions and the cover portion are preferably made of steel unless stated otherwise, but can be made of aluminum, fiber-reinforced polymer composites, ceramics, ceramic composites or any other suitable material as will be understood by a person of ordinary skill.

The door closer cover portion 6 includes a hollow rectangular tube 10 with a rectangular bore 11 extending the length thereof. The bore is preferably tapered to accommodate the v-shaped closer arms, and rubber material can be placed inside the bore 11 to further increase friction. The cover 6 works with a hydraulic, mechanical, pneumatic or other conventional door closer 8, which can be a commercial door closer sold by Stanley Security Solutions, Inc. of Indianapolis, Ind., or any equivalent door closer. Such door closers mount to a conventional swinging door or the doorframe above the door and have two arms pivotably mounted to one another. A first arm extends from a housing containing the mechanical apparatus, and the other arm pivotably mounts to the first arm at one end and the opposite end to the door or a doorframe. The door closer's arms pivot relatively to one another and to the door as the mechanism biases an open door to a closed position. When the door is closed, the arms are nearly parallel and form an acute angle with one another.

The tube 10 is retained on the closer arms by friction, but in order to provide further security it can have aligned holes 13 extending through two opposite sidewalls of the tube. In FIG. 1, the holes 13 extend vertically through the top and bottom walls of the tube 10, and these aligned holes 13 permit a pin 14 to be inserted therethrough for reasons that will be apparent from the description below. A hand-grippable handle 12 preferably extends perpendicularly from one side of the tube 10 to permit rapid deployment and removal of the cover 6 from the arms of a conventional hydraulic, mechanical or pneumatic door closer 8 by a human hand, which can readily grip and grasp the handle 12. The handle 12 can be extended downwardly for a shorter user to more easily install the cover portion 6, or it can be L-shaped to provide further advantages. A string 16 extends from attachment to the tube 10 and to the pin 14 so the pin 14 is not readily separated from the tube 10. Alternatively, the pin 14 can be magnetically or mechanically attached to the outer surface of the cover portion 6.

Figure 2:
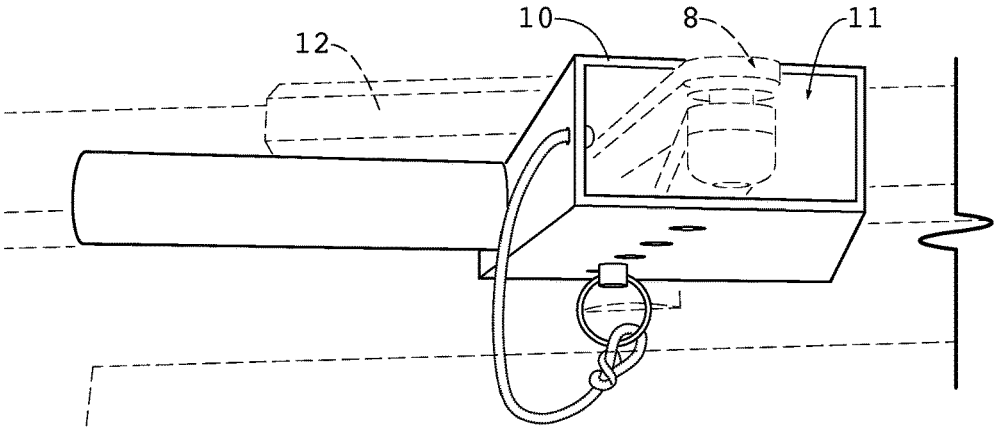
FIG. 2 is a view in perspective illustrating the embodiment of FIG. 1 from a different perspective.
Figure 3:
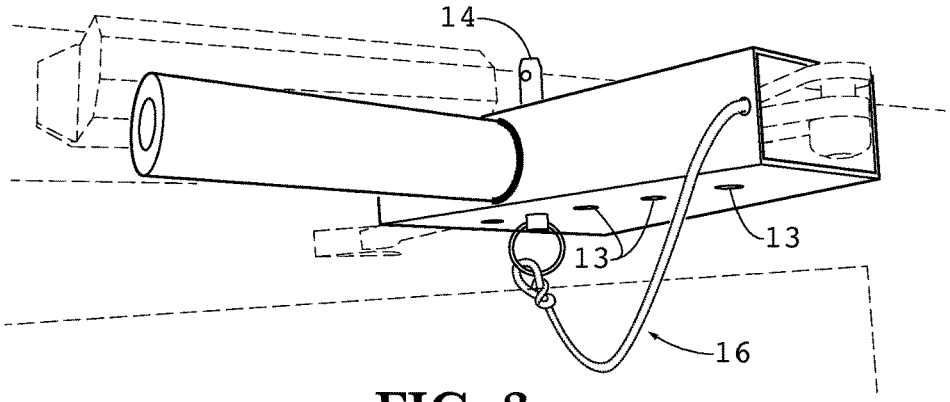
FIG. 3 is a view in perspective illustrating the embodiment of FIG. 1 from a different perspective.
Figure 4:
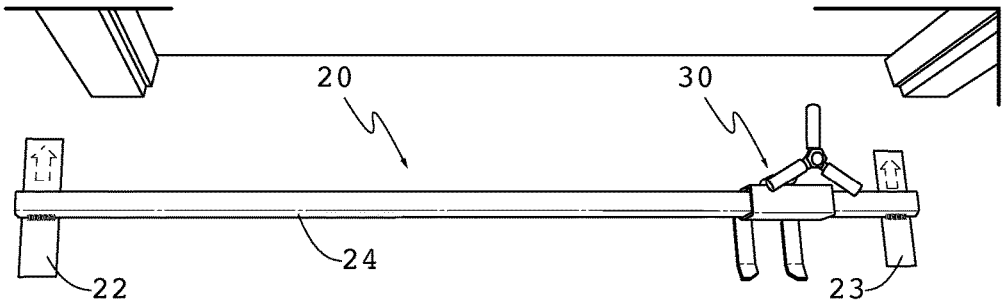
FIG. 4 is a front view illustrating an embodiment of the invention that mounts to a door and door-opening latch.
Figure 5:
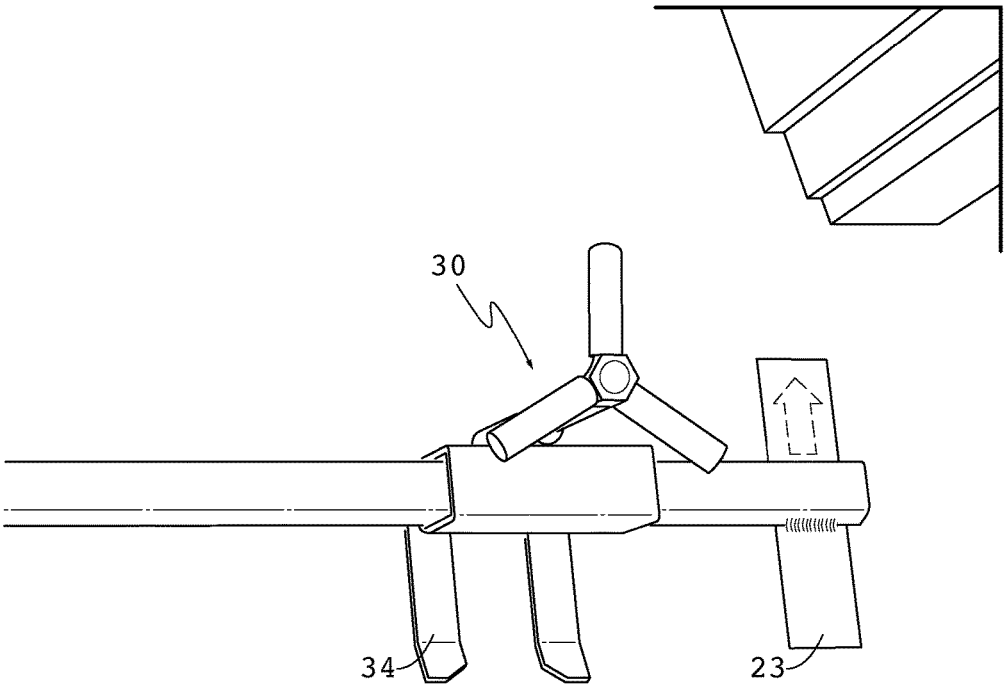
FIG. 5 is a front view illustrating a magnified view of the embodiment of FIG. 4.

In order to open a closed conventional door having a conventional door closer 8, the arms of the door closer 8 must be able to be spread apart from their nearly parallel relative orientation when the door is closed. Therefore, the cover portion 6 is slid over the nearly parallel arms of the door closer 8 when the door is in a closed position, as shown in FIGS. 1-3, thereby hindering the arms of the closer 8 from being spread apart. The pin 14 is preferably inserted into two of the aligned holes 13 that allow the pin 14 to extend between the two nearly parallel arms of the door closer 8. The pin 14 prevents any impact or shaking of the door from knocking the cover portion 6 off of the arms of the closer 8. In order to remove the cover portion 6, the pin 14 must be withdrawn from the aligned holes 13 in the opposite direction from its insertion, and the cover portion 6 is slid off the closer arms without the pin 14 (which was previously between the two arms) interfering with removal of the cover portion 6. The cover portion 6 thus resists spreading apart of the closer arms, thereby resisting the opening of the door to which the closer 8 is mounted.

Referring now to FIGS. 4-10, the bar portion 20 is described in detail. The bar portion 20 is preferably mounted to one side of a door that swings away from the properly mounted bar portion 20, either alone or in combination with the cover portion 6 described above. Thus, when the bar portion 20 is mounted in an operable configuration, it is locked to a door that is designed to swing away from the bar portion 20, and such a door is sometimes referred to herein as an "outwardly swinging door". An embodiment is disclosed below that locks an "inwardly swinging door" to prevent inward movement of the door. The embodiments that lock the inwardly and the outwardly swinging doors are discussed below without further reference to the cover portion 6. Nevertheless, the cover portion 6 can be used alone or in combination with each embodiment, and each embodiment can be used alone without the cover portion 6.

The bar portion 20 has a clamp 30 that attaches to a door-opening latch, such as the door knob 40, while the bar portion 20 is positioned with both bar ends extended to face the vertical doorframe members on opposite sides of the door. By facing the doorframe members, the device can be seated against the doorframe members or the wall adjacent the doorframe members. After the clamp 30 has been tightened, the door cannot be opened unless a component of the door or the bar portion 20 breaks.

The preferred bar portion 20 includes a tubular shaft 24 that can be positioned across the door. When mounted substantially horizontally as shown in FIGS. 4-10, the shaft 24 extends laterally to or beyond both vertical doorframe members 52 and 53 (see FIG. 6). In an alternative embodiment a shaft can be adjustable lengthwise by a telescoping construction of one piece fitting slidably into the other. This would provide an adjustable-length bar that could be used on virtually any door. However, the shaft 24 is preferably a single piece that is matched in length to the distance between the doorframe members 52 and 53, and if different sized doors are used, this shaft will be built to the desired size. Thus, the invention can be used on the smallest to the largest swinging doors (or pairs thereof used together) that are conventionally known. A single shaft 24 has neither a concentrated weakness nor an obstruction to free-sliding of the collar (described below) that might exist on a telescoping bar. Thus, while a telescoping bar is contemplated, it is preferably avoided due to the possibility of the installer making a mistake under the stress of the circumstances, structural weakness, and other reasons. Instead, preferably the shaft 24 is a single piece that is made for the size of the door it will be used on.

Feet 22 and 23 are fixed at or near the opposing ends of the shaft 24, which are positioned, in an operable embodiment, on opposite sides of the door. The feet 22 and 23 distribute any force applied to the bar portion 20, such as by a door that is being pulled on, over a larger surface area to prevent damage to the door trim and nearby wall. It is preferred to mount padding or other protective coatings, such as rubberized magnetic sheets or coatings, on the feet 22 and 23, to reduce or eliminate any damage to the wall or doorframe/trim. By distributing any force over a larger area, the feet 22 and 23 prevent destruction of the contacted surface, which destruction could allow entry by an unauthorized person. Magnetic material also presents an attraction to steel doorframe surfaces.

Figure 9:
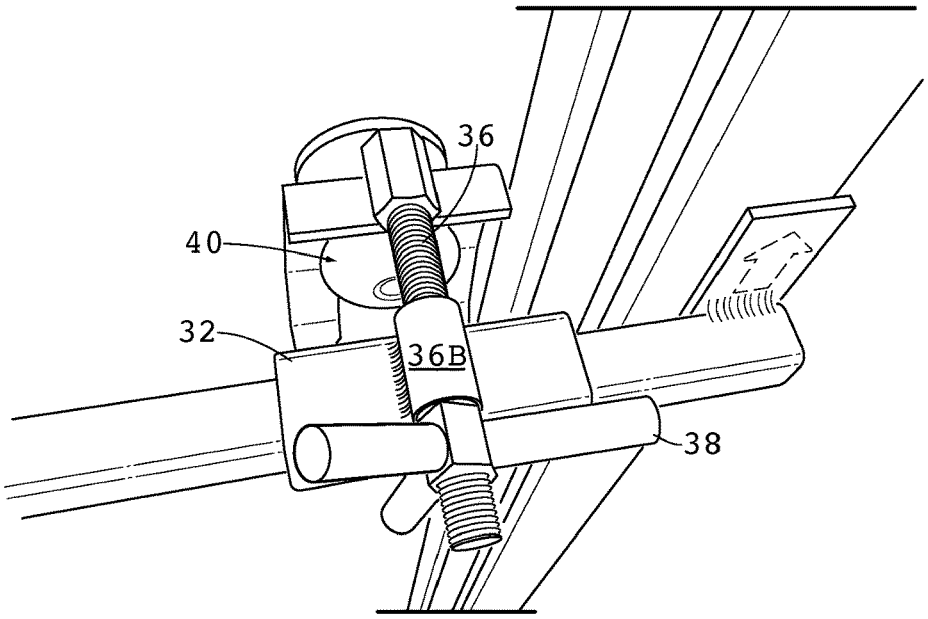
FIG. 9 is a top view in perspective illustrating the embodiment of FIG. 4 in an operable position.
Figure 10:
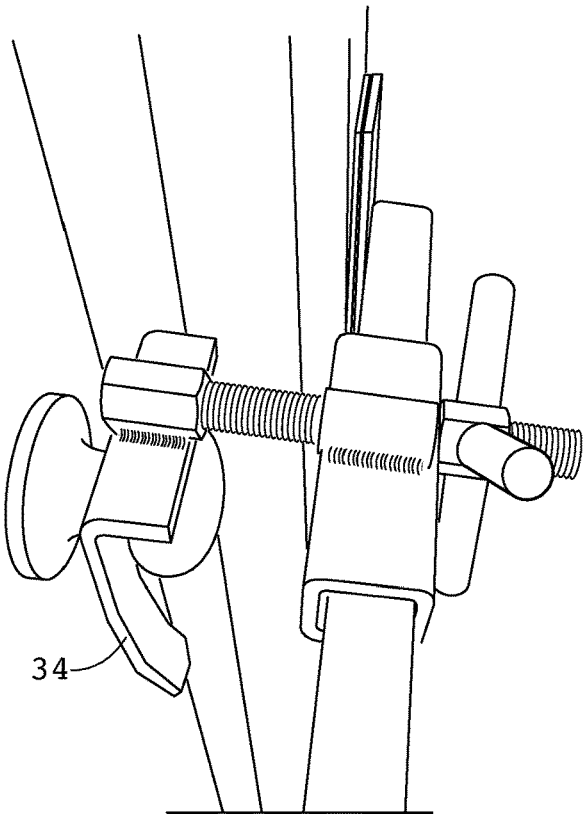
FIG. 10 is a top view in perspective illustrating the embodiment of FIG. 4 in an operable position from a different perspective than the illustration of FIG. 9.

As shown in FIGS. 9 and 10, the clamp 30 includes a preferably tubular collar 32 that extends slidably and coaxially around the shaft 24. Preferably the collar 32 has inner dimensions that are larger than the outer dimensions of the shaft 24, thereby permitting the coaxially mounted collar 32 to slide with little resistance along the shaft 24 from one foot 22 to the opposite foot 23. The feet 22 and 23 have dimensions that are substantially larger than the inner dimensions of the collar 32, and thereby prevent the collar 32 from sliding off the shaft 24. In the preferred embodiment, the feet are plates welded transversely to the bar 24. The movement afforded by the collar 32 allows a single apparatus to be used on a door that has a door latch anywhere along the width of the door. Typically doors have latches on the left or the right sides, or so-called "crash bars" or "panic bars" extending along the majority of a door's width. Panic bars will require a different attachment structure, but such a structure is contemplated.

Figure 6:
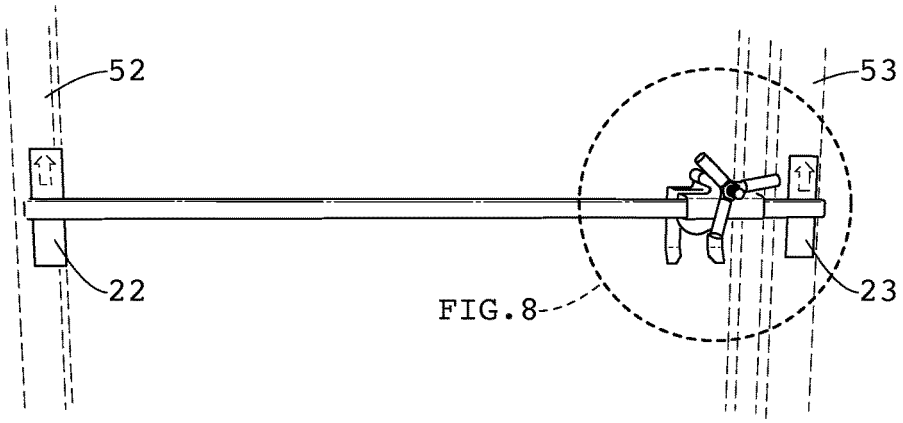
FIG. 6 is a front view illustrating the embodiment of FIG. 4 in an operable position mounted to a door and doorframe.
Figure 7:
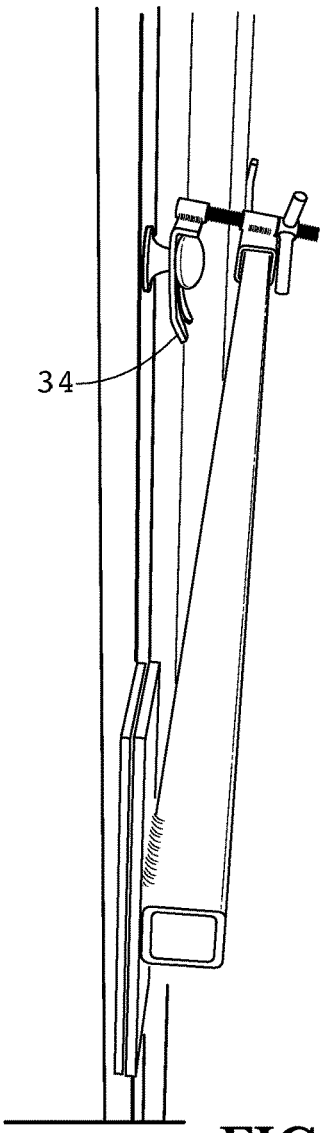
FIG. 7 is a view in perspective illustrating the embodiment of FIG. 4 in an operable position.
Figure 8:
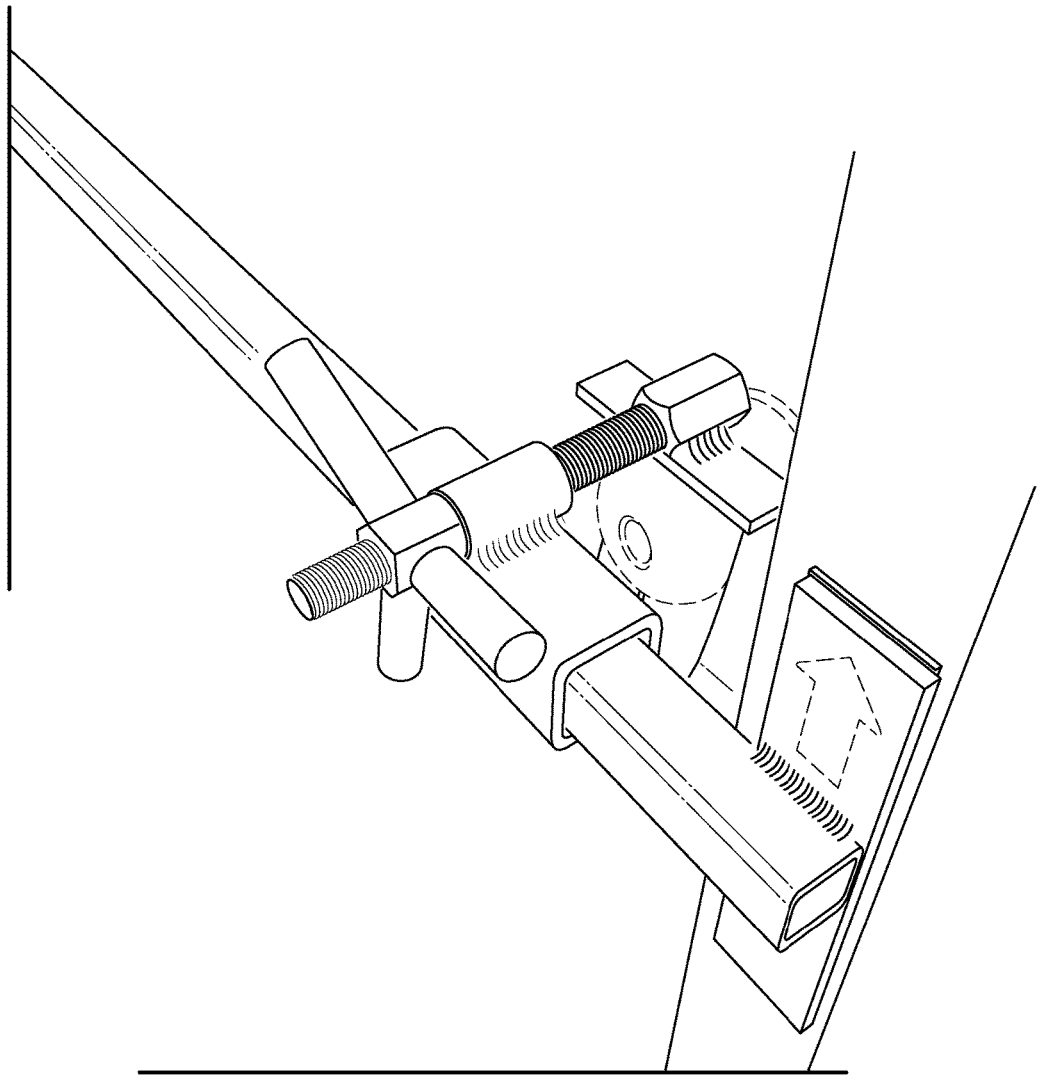
FIG. 8 is a view in perspective illustrating the embodiment of FIG. 4 in an operable position.

The clamp 30 is mounted to the collar 32, such as by welding, and includes a preferably U-shaped claw 34 and a tightening mechanism. In the preferred embodiment, the tightening mechanism includes a threaded rod 36 mounted to a handle 38 by a threaded bore extending therethrough, and a tube **36*b* rigidly mounted to the collar, such as by welding. It will be apparent that the handle 38 can have other shapes and configurations in order to provide a hand-engageable structure that also provides leverage to permit an average human to sufficiently tighten the tightening mechanism. The threaded rod 36 extends rotatably through the smooth bore of the tube 36*b*, and the opposite end of the threaded rod 36 is rigidly mounted to the claw 34, such as by welding. As the handle 38 is rotated in a first direction, the threaded rod 36 is displaced axially in the smooth bore of the tube 36*b*, and the claw 34 is drawn toward the collar 32 and shaft 24 with the threaded rod 36. When the handle 38 is rotated in the opposite, second direction, the claw 34 is moved away from the collar 32 and shaft 24. Thus, when the handle 38 is rotated in the first direction, the action of the tightening mechanism applies a force, preferably a tensile force, that causes the shaft 24 to be drawn toward the door knob 40 that is inside the claw 34. In this manner, as the door knob 40 is held tightly between the forked members of the claw 34, the feet 22 and 23 are drawn tightly against the doorframes 52 and 53, as shown in FIGS. 6 and 7, on opposite sides of the door. Upon final tightening, the combination of the shaft 24 and clamp 30 is tightly fixed with the feet 22 and 23 seated firmly against the wall or door trim and the claw 30 tightly pulling against the door knob 40**.

In this configuration, the door cannot be opened without rotating the handle 38 of the tightening mechanism numerous revolutions in the second direction to displace the claw 34 away from the shaft 24, or by breaking one of the components of the door or the bar portion 20. Because the handle 38 of the tightening mechanism can only be rotated from the side of the door on which the bar portion 20 is mounted, only a person on that side of the door can effectively open the door. In this manner, the bar portion 20 serves as a door lock that can be installed very quickly without substantial dexterity, strength or mechanical skill. One simply disposes the shaft 24 horizontally with the feet 22 and 23 against the doorframes 52 and 53, slides the collar 32 toward the door knob 40, places the claw 34 over the door knob 40 and tightens the handle 38 until a snug fit is achieved.

Once the device is in place as described above, it can be removed by simply rotating the handle 38 in the second direction to loosen the tightening mechanism, which allows the claw 34 to be lifted off the door knob and the entire bar portion 20 to be removed from the door. No fasteners or other permanently mounted structures are left behind after removal of the bar portion 20. Instead, the door and doorframe are exactly as they were prior to attachment.

If an intruder fires a weapon at the bar portion 20 when the bar portion 20 is in the operable position on the door, the bar portion 20 will have to sustain damage along the bar 24, claw 34, threaded shaft 36 or doorknob 40 in order to cause the bar portion 20 to become ineffective. Most firearms will not sufficiently damage the bar portion 20 to cause it to become ineffective without numerous impacts along a line to effectively sever the bar 24, shaft 36, or claw 34. Furthermore, the bar portion 20 is located on the opposite side of a door from the intruder, which keeps the bar portion 20 out of view of the intruder, meaning causing such damage is virtually impossible.

The preferred tightening mechanism on the bar portion 20 is the handle 38 with threaded rod 36, but others will be apparent to the person having ordinary skill from the description herein. For example, other manually-tightened devices using levers, cams, and mechanical drawing devices will be known to substitute for the preferred mechanism. Furthermore, mechanical devices, including but not limited to motors and pumps, will become apparent as more complex and automated mechanisms that could substitute for the preferred embodiment.

It will become apparent from the description herein that the type of door-opening latch or handle to which the clamp of the invention will attach can vary. Clearly equivalent door handles that are contemplated for the clamp to attach to include normal circular or equivalent knobs, as well as levers and even decorative door-opening mechanisms. It is also contemplated that so-called "crash bars" and "panic bars", which are commonly used on doors, can be mounted by a contemplated clamp that extends downwardly or to the side, to firmly attach to the panic bar, or by adapting the panic bar to provide an attachment point. A universal claw is contemplated to engage any door's handle, but it is also contemplated to design a claw to match a particular door knob, lever or other door-opening device. It is also contemplated that the term "door-opening latch" can encompass structures that are deliberately added to a door or its hardware in order to attach the present apparatus to the door in an advantageous manner. For example, a structure can be mounted to, or an opening formed in, a conventional door or doorknob mechanism to permit advantageous attachment to the present apparatus.

It should be noted that neither the shape nor the size of the shaft 24 are critical features of the invention. Furthermore, the precise mechanism by which the door knob 40 is clasped is not critical, nor are the existence, shape and size of the pads that seat against the doorframe. The shaft 24 can be sized and shaped to extend vertically or at an angle across the door, rather than horizontal, if sufficient doorframe support can be found at the lower and upper ends of the door to prevent movement of the bar sufficiently toward the door upon pulling of the door. All of the embodiments are contemplated to have no structures mounted to the door and/or surrounding structures prior to use of the bar portion 20, due to limitations caused by safety regulations.

It will be understood that the bar portion 20 has a bar 24 that extends across the door and extends laterally from one side of the door to the opposite side. The claw 34 attaches to the door knob 40 by extending down over both sides thereof, and a tightening mechanism draws the claw 34 toward the bar 24.

Figure 11:
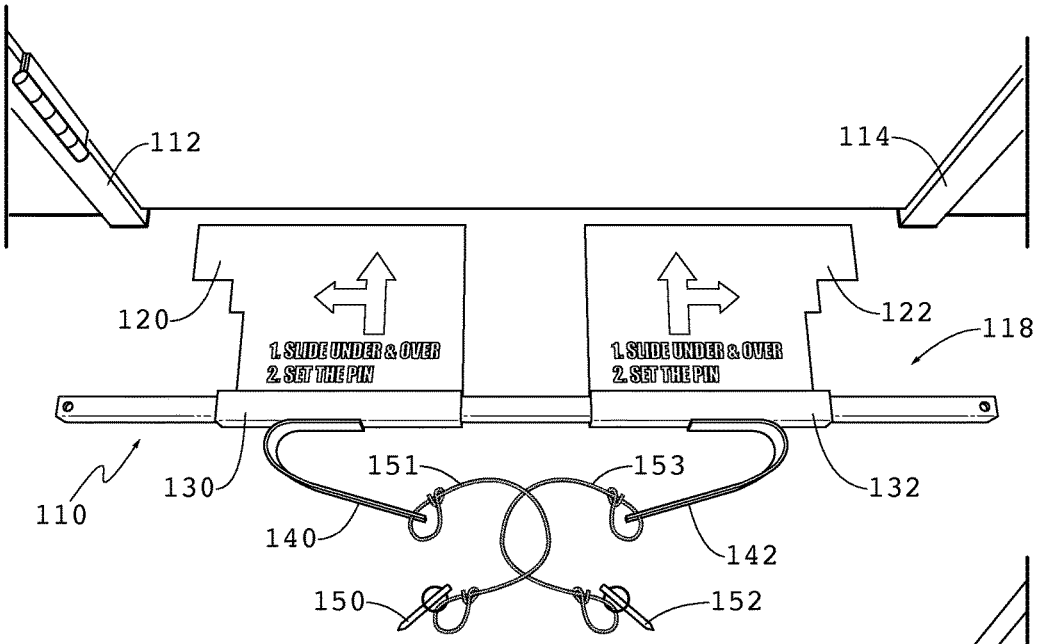
FIG. 11 is a top view illustrating an embodiment of the invention that mounts to a doorframe on opposing sides thereof.

As shown in FIG. 11, a second embodiment is used with a door that swings inwardly, which is defined as toward the side of the door on which the installer stands when the second embodiment is being installed. The second embodiment includes an elongated member, such as the bar 110, that extends longitudinally from the face of the left doorframe 112 to the face of the opposite, right doorframe 114, but the bar 110 can extend past one or both doorframes. The bar 110 is preferably square tubing, but could be any suitable shape, and is preferably about two inches tall and about two inches deep when used on a conventional door. This height is substantially greater than the gap beneath most interior doors, and, as will be understood from the description below, this allows the bar 110 to form an obstruction to door movement past the bar 110 when the bar 110 is in an operable position. As with the embodiments described above, all components of the apparatus described and shown in FIGS. 11-19 are made of steel unless stated otherwise, although other materials are contemplated as substitutes where sufficient for the purpose of the device. Of course, any size bar can be used, and it is preferred that a bar that matches the size of the door can be built to fit virtually any door.

During installation, the bar 110 is positioned on the inside of the door, in an operable position described below. When in the operable position the bar 110 prevents an intruder who is on the outside (opposite side of the door) from pulling the bar 110 under or through the door. Because the ends of the bar 110 extend laterally to, and possibly past, the doorframes 112 and 114, the bar 110 cannot be pulled beyond the doorframe without breaking the doorframes 112 and 114. It is essentially impossible for an intruder to break doorframes without tools. Furthermore, the intruder outside of the door cannot push the door beyond the edge of the bar 110 that faces the door. Thus, the device shown in FIGS. 11-19 prevents movement of the door past the device in its operable position.

Figure 12:
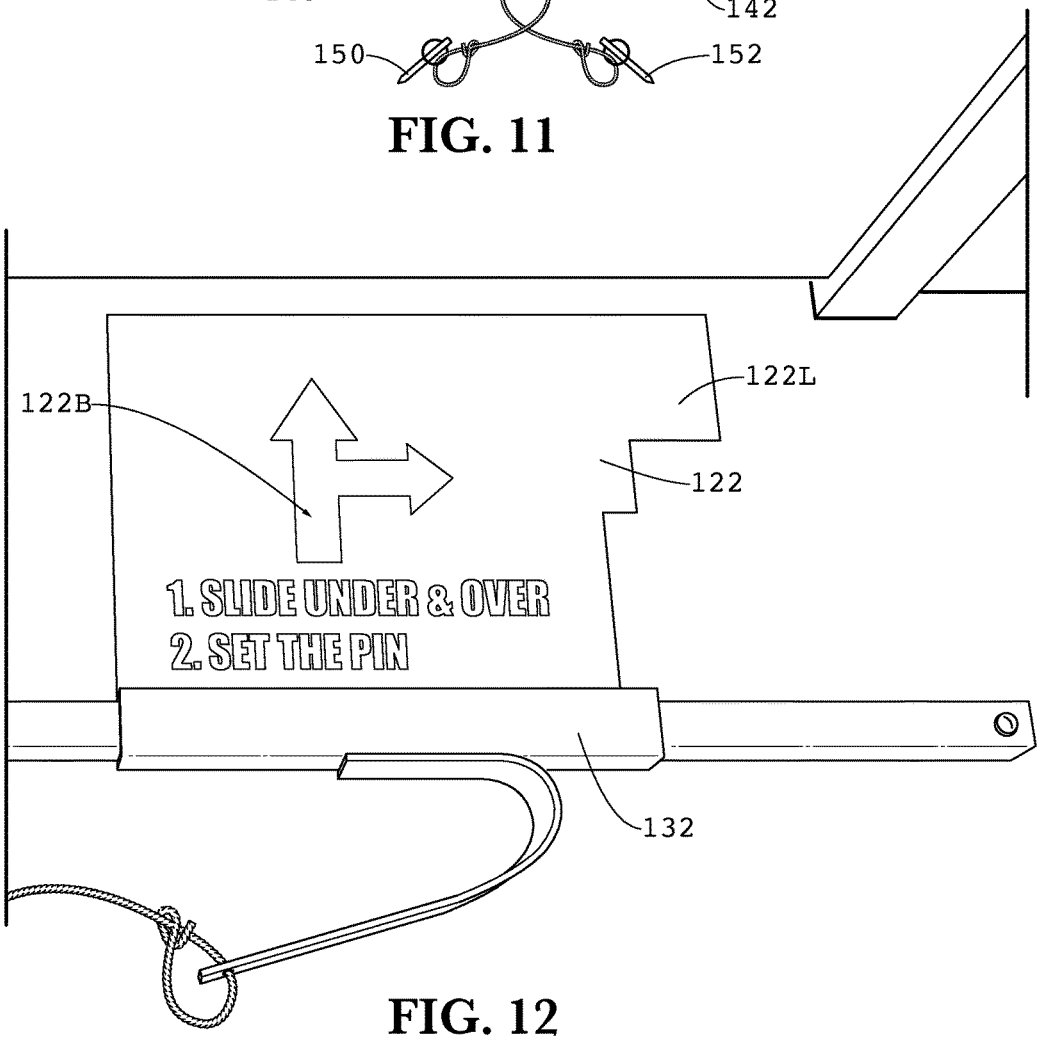
FIG. 12 is a top view illustrating a magnified view of the embodiment of FIG. 11.
Figure 14:
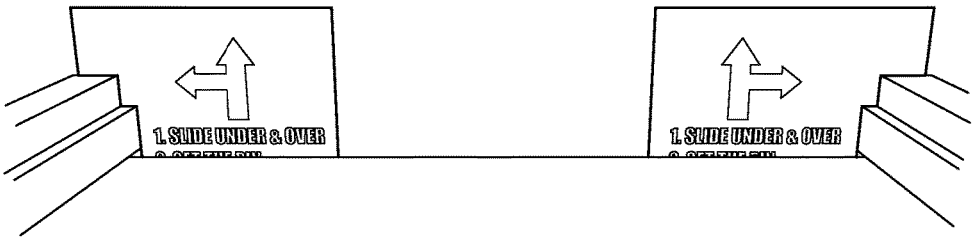
FIG. 14 is a top view illustrating the embodiment of FIG. 11 in an operable orientation beneath a door shown from the outside of the door.
Figure 15:
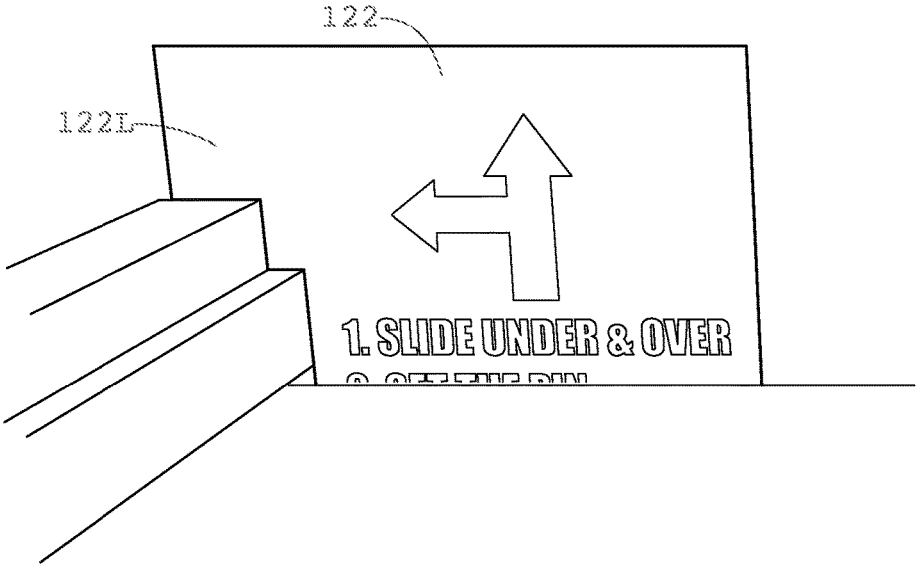
FIG. 15 is a top view illustrating a magnified view of one plate of the embodiment of FIG. 14.
Figure 18:
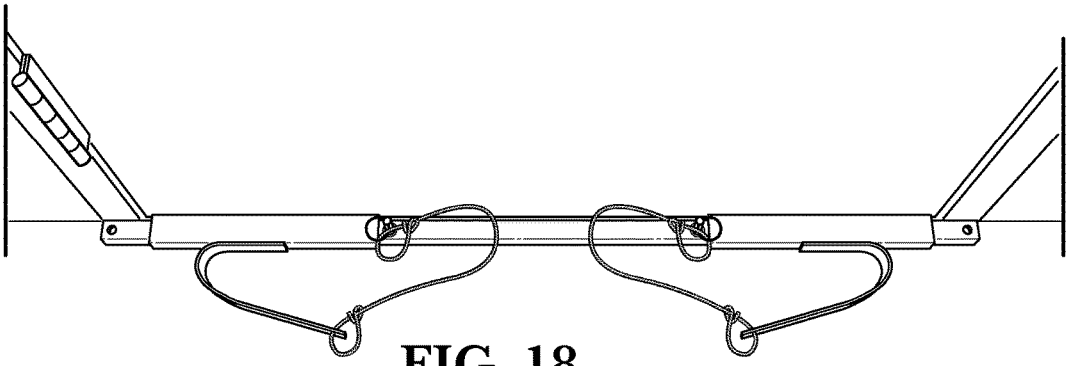
FIG. 18 is a top view illustrating the embodiment of FIG. 11 in an operable orientation beneath a door shown from the inside of the door and with the pins inserted.

Two plates 120 and 122 are slidably mounted to the bar 110, and are preferably shaped to conform to the opposing doorframes on the opposite, outer side of the door once the system is in an operable position (as shown in FIGS. 15 and 18). This allows the plates 120 and 122 to extend to the opposite sides of the doorframe from the bar 110. Alternative L-shaped plates also extend around the far side of the doorframes on the opposite, outer side of the door from the bar 110. As shown in FIGS. 11-15, the plates 120 and 122 are cut with a "stair-step" shape to match to the exterior shape of the doorframes the plates will encounter. Of course, any shape can be manufactured to match the desired contour, in order to cause the plates to extend to the distal side of the doorframes from the bar 110 to prevent the plates from being pushed beneath the door once the apparatus is desirably locked in position. The plates are described broadly herein as "L-shaped", because they have a base portion 122B that mounts to the collar and a leg portion 122L that extends laterally past the door jambs as shown in FIGS. 12 and 15 to the sides of the doorframes opposite the bar 110. The preferred plates have multiple legs to conform perfectly to the shapes of the doorframes shown, but can be modified to have only one leg that extends around doorframes.

The plates 120 and 122 are preferably rigidly mounted, such as by welding, to the edges of the collars 130 and 132, respectively, which are also preferably square tubing slightly larger than the exterior dimensions of the bar 110, and mounted slidably coaxially on the bar 110. This cooperative relationship renders the collars 130 and 132 slidable along the bar 110, and prevents the collars and plates mounted on the bar from moving a significant distance in any direction relative to the bar except along the bar's length. The lower faces of the plates 120 and 122 are generally co-planar with the lower faces of the collars 130 and 132 so that when the device rests on a planar surface such as a floor, the plates and collars contact the floor and the bar 110 is raised slightly above the floor. A stop 160 (FIG. 17) is mounted at the end of the bar 110 to block the plates from sliding off the bar 110. A similar stop is mounted at the opposite end of the bar 110 for a similar purpose.

During installation of the device 118, the plates 120 and 122 are slid underneath the door through a gap that exists between every interior door and the floor beneath it to permit the door to swing open without frictionally engaging the floor. Thus, the plates 120 and 122 are preferably less than about one-half inch thick, in order to be sure to fit through the gap of virtually any interior door, and are more preferably less than or equal to about one-quarter of an inch thick.

Figure 13:
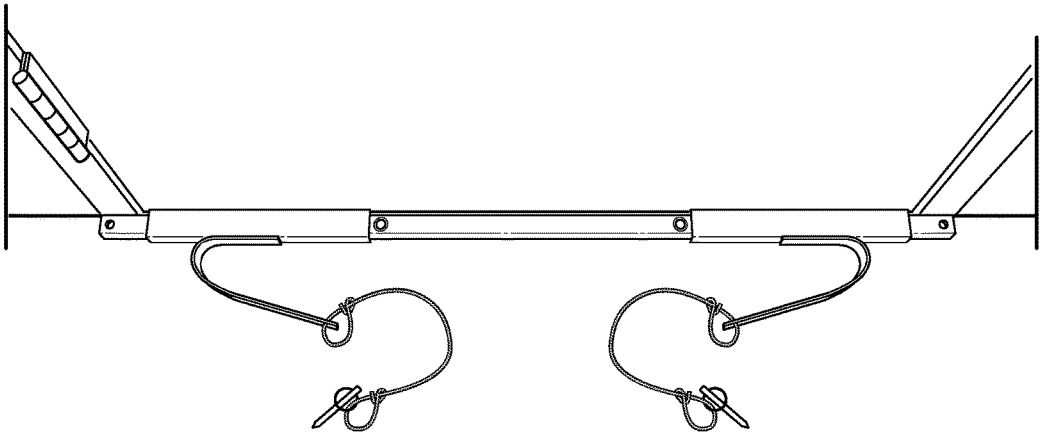
FIG. 13 is a top view illustrating the embodiment of FIG. 11 in an operable orientation beneath a door shown from the inside of the door and without the pins inserted.

Once the plates 120 and 122 are inserted in the gap beneath the door (as shown in FIGS. 13-15), the person installing the device pushes until the opposing ends of the bar 110 seat against the inner surfaces of the doorframes 112 and 114. At this position, the bar 110 ends rest against the interior of the doorframes. Once this occurs, the person moves the plates 120 and 122 along the length of the bar in opposite directions. This can be accomplished by using the handles 140 and 142 mounted to the collars 130 and 132, respectively, or by simply sliding the collars 130 and 132 along the bar 110. The plates 120 and 122 are moved until their opposing edges abut the facing sides of the doorframes 112 and 114. The outer legs of the plates 120 and 122 seat against or near the outer surfaces of the doorframes 112 and 114 while the bar 110 contacts the insides of the doorframes, and this configuration is shown in FIGS. 13-15. In an alternative embodiment contemplated, one of the plates is mounted directly to the bar and only one plate slides along the bar to adjust to fit the door on which the device is being used.

In summary, a person places the device 118 at the bottom of the closed door inside the room into which the door swings as shown in FIG. 11. The person next pushes the entire device toward the door to slide the plates 120 and 122 through the gap beneath the door until the collars 130 and 132 are adjacent the lower face of the door and the ends of the bar 110 rest against the interior faces of the doorframes as shown in FIG. 13. The installer next slides the plates 120 and 122 outwardly (away from one another) to fit against the doorframes on the outside of the closed door as shown in FIGS. 14 and 15. Once the bar 110 is in position resting against the insides of the doorframes 112 and 114, and the plates 120 and 122 are in position against the outsides of the doorframes 112 and 114, the installer locks the collars in place while still operating only from inside the door. In the preferred embodiment, the installer does so by inserting each of the two pins 150 and 152 into a corresponding aperture formed in the bar 110. The pins 150 and 152 extend into the corresponding apertures on the portion of the bar 110 that is between the two collars 130 and 132, with each pin thereby forming an obstruction to the collars 130 and 132 being displaced toward one another past the pins 150 and 152. Thus, the pins obstruct the movement of the plates toward one another.

The pins 150 and 152 are preferably ready for use and located near the apertures by being mounted to a respective one of the preferably flexible cables 151 and 153, which can be made of steel, plastic, composite or any suitable material. The cables 151 and 153 are preferably mounted to the handles 140 and 142, respectively to be close to their respective apertures. Thus, the pins 150 and 152 are always attached to the device and ready for insertion into the marked holes in the bar 110 to secure the plates in position. The holes are preferably encircled with bright paint or otherwise obviously marked for easy recognition. It should be noted that the shape of the handles is not critical, nor is their existence, because one can simply grip and move the collars by hand. Of course, the handles can alternatively be replaced by ridges protruding from or gripping material on the collars, an alternative U-shaped handle, or any other structure that can be used by a person to slide the collars along the bar 110.

Figure 16:
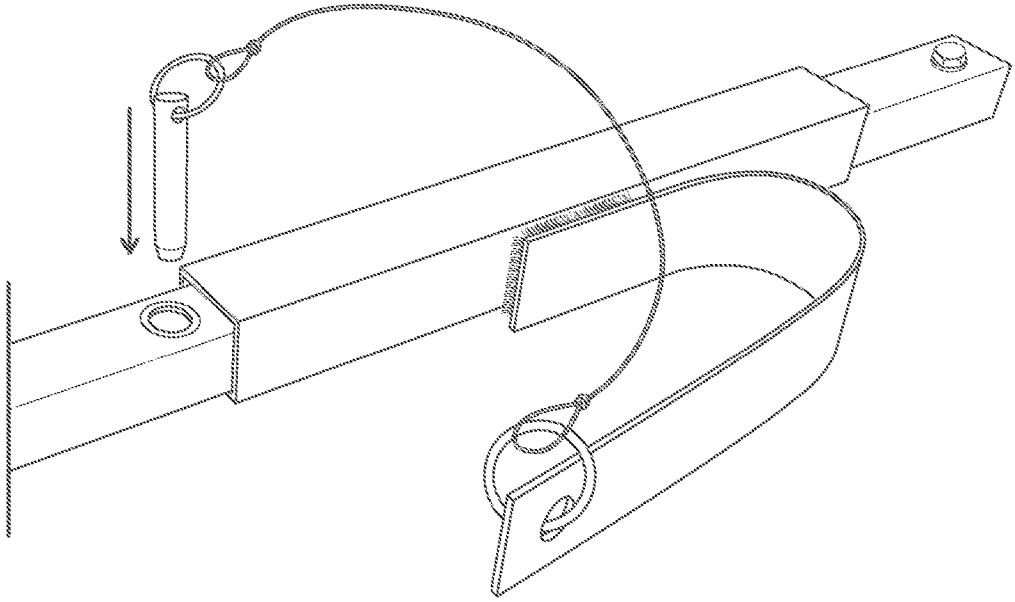
FIG. 16 is a view in perspective illustrating one end of the embodiment of FIG. 11 with a pin being inserted into an aperture.
Figure 17:
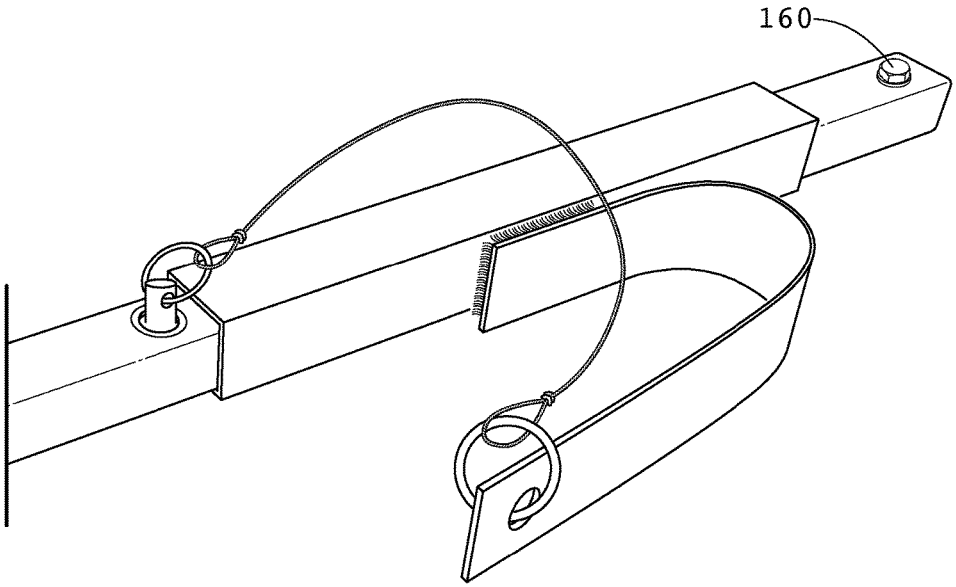
FIG. 17 is a view in perspective illustrating one end of the embodiment of FIG. 11 with a pin inserted into an aperture

When the pins 150 and 152 are inserted into the holes in the bar 110, as shown in FIGS. 16-18, they obstruct the collars 130 and 132, along with the attached plates 120 and 122, from being slid toward one another along the bar 110. And because the pins are not accessible from outside the room, the plates 120 and 122 cannot be moved inwardly without access to the interior of the room. This prevents opening of the door except by one who can access the pins.

The pins 150 and 152 are preferred because they are simple mechanical devices for restricting inward movement, but any structure that prevents inward movement of the collars and plates is contemplated. This includes, but is not limited to, clamps, collars, bolts, rings that extend through holes, spring-loaded shafts, or any proprietary fastener that obstructs the movement of the collars and/or the plates. The pins are effective even if a projectile or other object breaks the top off, because the remaining portion obstructs the movement of the collars and/or the plates.

When the apparatus is in the operable position shown in FIG. 18, the door cannot be opened without removing the pins 150 and 152 and sliding the plates 120 and 122 inwardly. This is because the legs of the plates 120 and 122 abut the exterior of the doorframes, and the ends of the bar 110 abut the interior of the doorframes. Of course, the ends of the bar 110 need not abut interior doorframes, because all that is required to obstruct when the plates 120 and 122 are on the outside of the door is that the bar 110 and/or collars 130 and 132 be on the inside and extend above the lowest edge of the door. The door cannot be pulled toward the intruder because the door does not swing in that direction, and the door cannot be pushed inwardly significantly because the door's lower edge stops when it hits the bar 110 and/or collars 130 and 132. Nevertheless, it is preferred to seat the bar 110 against the inner faces of the doorframes.

Figure 19:
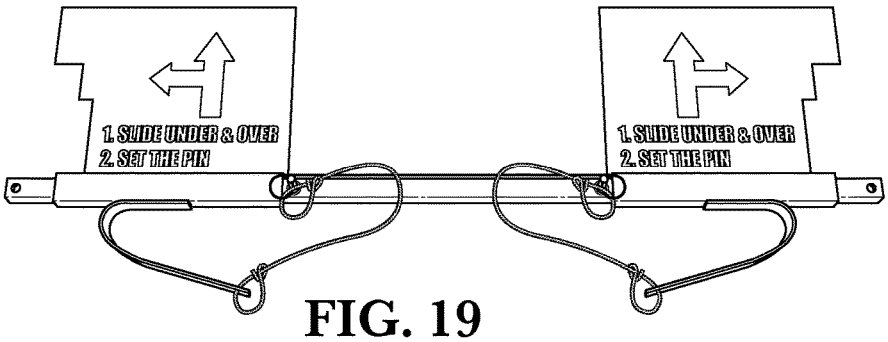
FIG. 19 is a top view illustrating the embodiment of FIG. 11 in an operable configuration without being positioned beneath a door.

When the apparatus of FIGS. 11-19 is in the operable position, it is strong enough to prevent opening of the door from the outside by the average, or even a very strong, person. The reason is that the bar 110 is tall enough that the top is above the lower edge of the door, so that the door cannot pass over the bar 110. In a preferred embodiment, the bar 110 is about two inches tall, and about two inches deep. These dimensions can be varied as will become apparent to the person of ordinary skill. Nevertheless, by so positioning the bar to extend above the floor at least about two inches, which is substantially greater than the gap typically formed between most doors and the floors beneath them, the bar 110 and/or the collars 130 and 132 form a "wall" at a preferably ninety degree angle relative to the planes of the plates 120 and 122, against which the door will abut if an intruder attempts to open the door when the device is in an operable position. It should be noted that FIG. 19 shows the plates 120 and 122 in the same position relative to the bar as in FIG. 18, but without the plates 120 and 122 being positioned under the door, and this is for illustrative purposes.

In order to remove the device when it is in the operable position shown in FIG. 18, one must remove at least one of the pins 150 and 152. Removal of both pin 150 and 152 allows both plates 120 and 122 to be slid along the bar 110 toward each other, and then the entire device can be pulled inwardly. The device is thus removed completely from the door without any structure remaining. If only one of the pins is removed, the associated plate can be slid along the bar 110, thereby permitting one end of the bar 110 to be pulled inwardly into the room. The second end of the bar 110 can be removed by displacing the entire apparatus along the length of the bar 110 away from the doorframe. Once the L-shaped plate that is still locked to the bar 110 clears the opposite (outer) side of the doorframe, the second end of the bar 110 can be pulled inwardly into the room.

In order for a door to be opened when the apparatus of FIGS. 11-19 is positioned in an operable position as shown in FIG. 18, the outer legs of both plates 120 and 122 must be removed. Removal of just one of the outer legs will not allow the device to be pivoted around the intact plate because of the geometrical relationship between the faces of the plates that are against the doorframes. It is possible to remove the device by completely severing the bar 110, but this is virtually impossible because the intruder is on a side of the door that prevents him or her from seeing the bar 110.

The apparatus of FIGS. 11-19 does not violate any safety codes of which the inventor is aware, because it does not permanently attach to the door, doorframe or any adjacent or abutting structure prior to use. Instead, the apparatus is completely separate from the door before use. During use, the apparatus is positioned against both sides of the doorframe, but can readily be removed by merely removing both pins, sliding the plates inwardly toward one another, and sliding the plates out from beneath the door.

With the development of this inwardly swinging door barricade the apparatus effectively prevents a shooter or other intruder from gaining access through an inwardly swinging door. By effectively deploying the previously mentioned hydraulic door closer device and the device for outwardly swinging doors as described above, the system can help prevent a shooter from gaining access to both inwardly and outwardly swinging doors.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An apparatus mounted to a swinging door for preventing the pivoting of the door, the door having a first door edge pivotably mounted to a first doorframe member and an opposing, second door edge removably attached to a second doorframe member by a mechanism that includes a door-opening handle, the apparatus comprising:

(a) an elongated member having a first end seating against the first doorframe member and a second end seating against the second doorframe member, the first and second ends being moveable relative to the doorframe members;

(b) a threaded shaft extending from the elongated member and terminating in a pair of fingers, each of the fingers extending on an opposite side of the door-opening handle, the fingers applying a tensile force through the shaft to the door-opening handle, the tensile force pulling the door-opening handle toward the elongated member, thereby seating the first and second ends against their respective door frame members, which seating limits movement of the first and second ends toward the door.

2. An apparatus for preventing the pivoting of a swinging door that has a first door edge pivotably mounted to a first doorframe member and an opposing, second door edge removably attached to a second doorframe member by a mechanism that includes a door-opening handle, the apparatus comprising:

(a) a bar that is at least as long as a distance from the first doorframe member to the second doorframe member, the bar having first and second opposing ends of the bar for seating adjacent the first and second doorframe members;

(b) spaced fingers mounted to the bar between the first and second bar ends for positioning the spaced fingers around the door-opening handle; and (c) a tightener configured for tightening by a human hand, the tightener including:

(i) a threaded shaft extending from the bar to the spaced fingers;

(ii) a shaft handle that is mounted to the threaded shaft and extends radially from the threaded shaft to permit manual rotation of the shaft handle to thereby apply a force between the spaced fingers and the first and second ends.

3. A method for preventing the opening of a swinging door that has a first door edge pivotably mounted to a first doorframe member and an opposing, second door edge removably attached to a second doorframe member by a mechanism that includes a door-opening handle, the method comprising:

(a) seating opposite, corresponding first and second ends of an elongated member against the first doorframe member and the second doorframe member without forming structures on the doorframe members that limit movement of the first and second ends;

(b) attaching the elongated member to the door-opening handle by extending at least two spaced fingers around opposing sides of the door-opening handle; and (c) applying a force between the door-opening handle and the elongated member by manually rotating a shaft handle that is mounted to, and extends radially from, a threaded shaft extending between the elongated member and the fingers, thereby causing the first and second ends to seat against the first and second doorframe members with the fingers pulling the door-opening handle.

4. An apparatus mounted to a swinging door for preventing the opening of the door, the door having a first door edge pivotably mounted to a first doorframe member and an opposing, second door edge removably attached to a second doorframe member by a door handle and a drivingly linked closure mechanism, the apparatus comprising:

(a) a bar that is at least as long as a distance from the first doorframe member to the second doorframe member, the bar having first and second opposing ends seating adjacent the first and second doorframe members;

(b) at least two spaced fingers disposed on opposite sides of the door handle, the fingers being attached to the bar between the first and second ends; and (c) a tightener including:

(i) a threaded shaft extending from the bar to the fingers;

(ii) a shaft handle mounted to the threaded shaft and extending radially from the threaded shaft to permit manual rotation of the shaft handle and thereby apply a force between the fingers and the first and second ends, thereby causing the first and second ends to seat adjacent the first and second doorframe members with the fingers pulling against the door handle.

5. The apparatus in accordance with claim 4, further comprising a collar slidably mounted around the bar to which the threaded shaft movably mounts.

* * * * *